US005095314A

United States Patent [19]

Shinnai et al.

[11] Patent Number: 5,095,314

[45] Date of Patent: Mar. 10, 1992

[54] VEHICLE ROOF GLASS ANTENNA FOR RECEPTION OF FM RADIO AND TV BROADCASTING

[75] Inventors: Masao Shinnai; Kazuya Nishikawa; Tokio Tsukada; Tohru Hirotsu, all of Matsusaka, Japan

[73] Assignee: Central Glass Company, Limited, Ube, Japan

[21] Appl. No.: 527,297

[22] Filed: May 23, 1990

[30] Foreign Application Priority Data

May 30, 1989 [JP] Japan ..... 1-136987

[51] Int. Cl.[5] ..... H01Q 1/32

[52] U.S. Cl. ..... 343/713; 343/711

[58] Field of Search ..... 343/713, 715, 711

[56] References Cited

U.S. PATENT DOCUMENTS 4,608,570 8/1986 Inaba et al. ..... 343/713
4,721,964 1/1988 Sato et al. ..... 343/713

FOREIGN PATENT DOCUMENTS 3738226 5/1989 Fed. Rep. of Germany .
3824417 1/1990 Fed. Rep. of Germany .
56-22807 7/1954 Japan .
62-43905 2/1987 Japan .
62-81101 4/1987 Japan .

*Primary Examiner*—Michael C. Wimer
*Assistant Examiner*—Hoanganh Le
*Attorney, Agent, or Firm*—Fleit, Jacobson, Cohn, Price, Holman & Stern

[57] ABSTRACT

The invention relates to an antenna attached to a vehicle roof glass, i.e. a glass plate fitted in an opening of the roof of a vehicle body, for receiving FM radio and TV broadcast waves in both the VHF band and the UHF band. Essentially the antenna is comprised of a main element which is combination of two linear segments each of which is a conductive strip attached to the roof glass, a feed point attached to the roof glass and a connection line which connects the main element to the feed point and extends parallel or nearly parallel to the longitudinal center axis of the vehicle body. The two linear segments of the main element extend respectively obliquely with respect to the aforementioned center axis and intersect each other. It is suitable that the two linear segments have the same length and bisect each other. Optionally the antenna may include an auxiliary element attached to the roof glass and connected to the feed point. For example, the auxiliary element may be a combination of two linear segments intersecting each other or an angled segment having at least one L-shaped portion.

43 Claims, 2 Drawing Sheets

VEHICLE ROOF GLASS ANTENNA FOR RECEPTION OF FM RADIO AND TV BROADCASTING

BACKGROUND OF THE INVENTION

This invention relates to an antenna provided to a vehicle roof glass, which means a glass plate fitted in an opening of a vehicle roof, for receiving FM radio and television (TV) broadcast waves. The principal element of the antenna is a conductive strip attached to the roof glass in a suitable pattern. The antenna is particularly suited to automobiles.

In recent automobiles there is an increasing trend to adoption of a "sun roof" or "sky roof" which means forming an opening in the roof of the car body and fitting a glass plate in the opening. In the present specification, that glass plate will be called a roof glass.

For the reception of radio and/or TV broadcast waves it is known to provide an automobile window glass with an antenna which is constructed of conductive strips printed on the window glass in a suitable pattern. Also it has been proposed to provide an antenna of a similar type to an automobile roof glass (e.g., JP-A (Utility Model) 56-22807). However, with automobile roof glass antennas proposed until now it is difficult to realize high reception gains over a wide range of frequencies including the FM bands for radio broadcasting and the VHF and UHF bands for TV broadcasting casting mainly because a roof antenna has to be constructed in a relatively narrow area.

SUMMARY OF THE INVENTION

It is an object of the invention to provide a vehicle roof glass antenna which is particularly suited to automobiles and functions as a wide-band antenna capable of receiving FM radio broadcast waves and TV broadcast waves in both in VHF band and the UHF band with sufficiently high gains.

The present invention provides an antenna attached to a vehicle roof glass for receiving broadcast waves, the antenna comprising a main antenna element which is a combination of two linear segments each of which is a conductive strip attached to the glass plate, a feed point attached to the glass plate and a connection line which connects the main antenna element to the feed point and extends parallel or nearly parallel to the longitudinal center axis of the vehicle body. The two linear segments of the main element respectively extend obliquely with respect to the aforementioned center axis, and the two segments intersect each other.

In this antenna it is preferably that the two linear segments of the main element have the same length and bisect each other. With the two segments in such arrangment it is suitable that the main element has a length (the maximum distance between the two segments: L in FIG. 1) in the range from 80 to 500 mm with the proviso that the width of the main element (the distance of an end of one segment from the nearer end of the other segment: W in FIG. 1) is in the range from 5 to 150 mm. It is suitable to extend the aforementioned connection line from the intersection of the two segments of the main element.

It is preferable to dispose the main antenna element in a central region of the roof glass, though this antenna elemetn can be disposed in any region of the roof glass insofar as the distance of the antenna element from every edge of the roof glass is not shorter than 30 mm.

Also it is preferable to dispose the feed point and the connection line on or near the longitudinal center axis of the roof glass. In such an arrangement, the length of the connection line has little influence on the reception characteristics of the antenna. However, when the main antenna element is distant from the center axis the feed point and the connection line can be disposed distant from the center axis. Usually the feed point is positioned at a short distance from the front or rear edge of the roof glass, and the efficiency of the antenna does not significantly differ whether the feed point is near the front edge or near the rear edge.

A vehicle roof glass antenna according to the invention can be constructed in a relatively narrow area, and this antenna serves as a wide-band antenna which exhibits sufficiently high gains in receiving FM radio broadcast waves, of both the 76–90 MHz band used in Japan and the 88–108 MHz used in many other countries, and TV broadcast waves of both the VHF band and the UHF band. This invention is very suitable for application to automobiles.

To further augment the reception gains of an antenna according to the invention it is optional to supplement the main antenna element with an auxiliary antenna element which is a conductive strip or a combination of conductive strips connected to the feed point by connection with either the main antenna element or the aforementioned connection line. For example, the auxiliary element may be a straight segment, a bending segment or a combination of two straight segments intersecting each other. To gain the favorable effect of the auxiliary element, this element is designed so as to adjust the resistance and reactance of the antenna for the sake of impedance matching of the antenna with the feeder.

DESCRIPTION OF THE PREFERRED EMBODIMENTS

Figure 1:
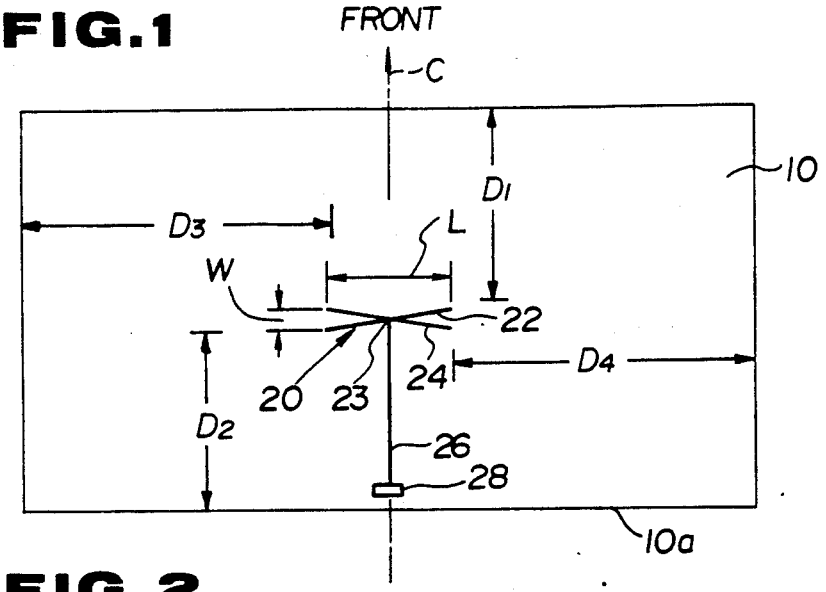
FIG. 1 is a plan view of an automobile roof glass antenna as an embodiment of the invention.

FIG. 1 shows an embodiment of the invention in an automobile roof glass. A single piece of glass plate 10 is used as the roof glass. An antenna of the following construction is disposed on the inboard surface of the roof glass 10.

The antenna has a main antenna element 20 which is a combination of two linear segments 22 and 24 each of which is a conductive strip formed by printing a conductive paste onto the glass surface and, after drying, baking the glass plate 10 with the printed paste thereon. The two segments 20 and 22 extend respectively obliquely with respect to the longitudinal center axis C of the car body and intersect each other so as to bisect each other. The main antenna element 20 is positioned in a central region of the roof glass 10 such that the intersection 23 of the two segments 22 and 24 is on the center axis C. From the intersection 23 a connection line 26 extends to a feed point 28 which is disposed at a short distance from the rear edge 10*a* of the roof glass 10. The connection line 26 and the feed point 28 are on the center axis C. The connection line 26 and the feed point 28 are provided on the glass surface by the aforementioned print-and-bake method.

EXAMPLE 1

An automobile roof glass antenna of the construction and arrange ment shown in FIG. 1 was produced with the following dimensions.

The roof glass 10 was 580 mm in width perpendicular to the center axis C and 320 mm in length. The main antenna element 20 was 100 mm in length and 10 mm in the width W. The connection line 26 had a length of 120 mm, and the feed point 28 was at a distance of 20 mm from the rear edge 10*a* of the roof glass.

Gains of the antenna of Example 1 in receiving FM radio broadcast waves and TV broadcast waves (horizontally polarized waves) were measured and compared with gains of a standard dipole antenna. That is, for any given frequency the gain of the dipole antenna was taken as the basis, 0 dB, and the gain of the sample antenna was marked on this basis. As the result, reception gain of the antenna of Example 1 was −19.3 dB on an average in the Japanese domestic FM radio broadcasting band of 76–90 MHz, −17.7 dB on an average in the foreign FM broadcasting band of 88–108 MHz, −17.5 dB on an average in the VHF TV broadcasting band of 90–222 MHz and −16.0 dB on an average in the UHF TV broadcasting band of 470–770 MHz. For comparison, by the same testing a good example of conventional automobile rear window glass antennas exhibited an average gain (vs. dipole antenna) of about −21 dB in either of the two FM radio broadcasting bands and about −20 dB in either of the VHF and UHF TV broadcasting bands. Therefore, the roof glass antenna of FIG. 1 is judged to be very good wide-band antenna for receiving FM radio and TV broadcast waves.

To confirm the dependence of the efficiency of the antenna of FIG. 1 on the length L and the maximum width W of the main element 20, the antenna of Example 1 was modified by variously decreasing and increasing the width W or by variously decreasing or increasing the length L. Average reception gains (vs. dipole antenna) of the modified antennas in the respective frequency bands were as shown in Table 1.

TABLE 1

| Main Element | | Average Gain (dB) | | | |
|---|---|---|---|---|---|
| L | W | FM Radio | | TV | |
| (mm) | (mm) | 76–90 MHz | 88–108 MHz | VHF | UHF |
| 100 | 5 | −19.7 | −17.8 | −17.6 | −15.9 |
| | 10 | −19.3 | −17.7 | −17.5 | −16.0 |
| | 30 | −19.5 | −17.6 | −17.6 | −16.2 |
| | 50 | −19.8 | −17.6 | −17.8 | −16.1 |
| | 100 | −19.8 | −17.8 | −18.1 | −16.6 |
| | 130 | −20.1 | −18.5 | −18.8 | −17.5 |
| | 150 | −21.8 | −19.9 | −20.3 | −18.8 |
| | 180 | −23.1 | −21.7 | −22.2 | −21.2 |
| | 200 | −24.7 | −23.7 | −23.3 | −22.4 |
| 50 | 30 | −22.1 | −19.9 | −22.7 | −19.2 |
| 80 | | −20.2 | −18.2 | −17.8 | −16.0 |
| 100 | | −19.5 | −17.6 | −17.6 | −16.2 |
| 200 | | −19.6 | −17.3 | −18.1 | −17.0 |
| 300 | | −19.8 | −17.8 | −18.0 | −17.9 |
| 400 | | −20.1 | −18.7 | −19.7 | −18.5 |
| 500 | | −20.5 | −19.3 | −20.3 | −19.7 |
| 600 | | −22.1 | −20.7 | −22.2 | −20.8 |
| 700 | | −23.9 | −22.9 | −24.1 | −22.3 |

The above test results indicate that the antenna of FIG. 1 realizes high reception gains in any of the four bands when the length L of the main element 20 is in the range from about 80 mm to about 500 mm and the width W of the main element is in the range from about 5 mm to about 150 mm. In view of the above and other test results, in the present invention it is preferable that the length L of the main antenna element 20 falls in the range from 80 to 300 mm while the width W is in the range from 5 to 100 mm.

The following Examples 2 to 5 relate to the addition of an auxiliary antenna element, to the roof glass antenna of Example 1. In every case there was no change in the size of the roof glass and the arrangement of the main antenna element 20 and the feed point 28, and the dimensions of the main element 20 were the same as in Example 1.

EXAMPLE 2

Figure 2:
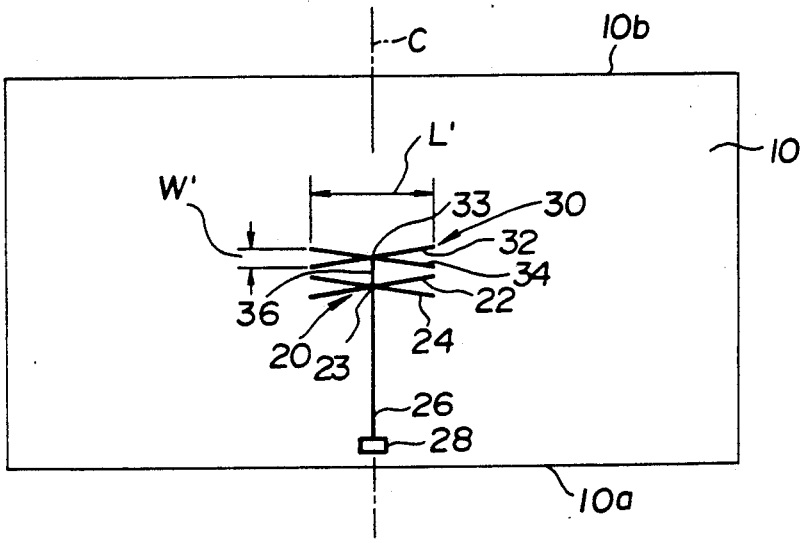
FIGS. 2 to 5 show four different modifications of the antenna of FIG. 1, respectively, each modification being the addition of an auxiliary antenna element.

FIG. 2 shows the antenna of Example 2. This antenna include an auxiliary antenna element 30 between the main antenna element 20 and the front edge 10*b* of the roof glass 10. The auxiliary element 30 was a combination of two linear segments 32 and 34 respectively extending obliquely with respect to the center axis C of the vehicle body and intersecting each other to bisect each other. That is, this element 30 was similar to the main element 20. The auxiliary element 30 was arranged so as to be bisected by the center axis C, and the intersection 33 of the two segments 32, 34 was connected to the intersection 23 of the main element 20 by a connection line 36. The length L′ of the auxiliary element 30 was 100 mm, and the width W′ of this element was 10 mm.

EXAMPLE 3

Figure 3:
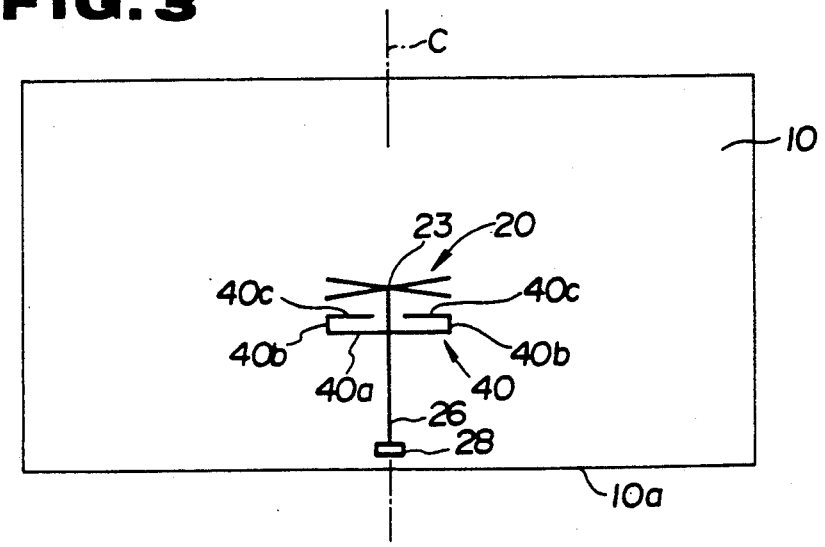

FIG. 3 shows the antenna of Example 3. This antenna included an auxiliary antenna element 40 between the main element 20 and the feed point 28. The auxiliary element 40 was a conductive strip bent so as to make a rectangle with a gap in one side thereof. That is, this element 40 had a lateral segment 40*a* arranged so as to be bisected by the connection line 26, two longitudinal segment 40*b* extending parallel to the center axis C from the two opposite ends of the lateral segment 40*a*, respectively, and two short lateral segments 40*c* respectively extending from the ends of the two longitudinal segments 40*b* toward the center axis C. The lateral segment 40*a* was 100 mm long; each of the longitudinal segments 40*b* was 10 mm long; and each of the two short lateral segments 40*c* was 40 mm long. The intersection 43 of the auxiliary element 40 and the connection line 26 was at a distance of 25 mm from the intersection 23 of the main element 20.

EXAMPLE 4

Figure 4:
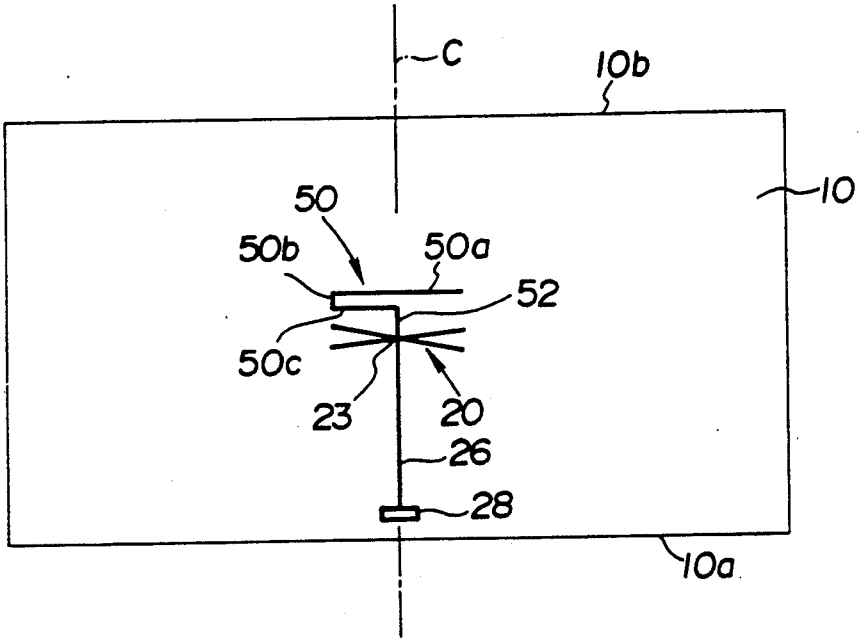

FIG. 4 shows the antenna of Example 4. This antenna included an auxiliary antenna element 50 between the main element 20 and the front edge 10*b* of the roof glass 10. The auxiliary element 50 was a conductive strip bent so as to make a portion of the perimeter of a rectangle. That is, this element 50 had a lateral segment 50*a* arranged so as to be bisected by the center axis C, a longitudinal segment 50*b* extending from one end of the lateral segment 50*a* toward the main element 20 and another lateral segment 50*c* extending from the end of the longitudinal segment 50*b* to the center axis C. At the end of the segment 50*c*, the auxiliary element 50 was connected to the intersection 23 of the main element 20 by a connection line 52 which was 25 mm long. The lateral segment 50*a* was 100 mm long; the longitudinal segment 50*b* was 10 mm long; and the lateral segment 50*c* was 50 mm long.

EXAMPLE 5

Figure 5:
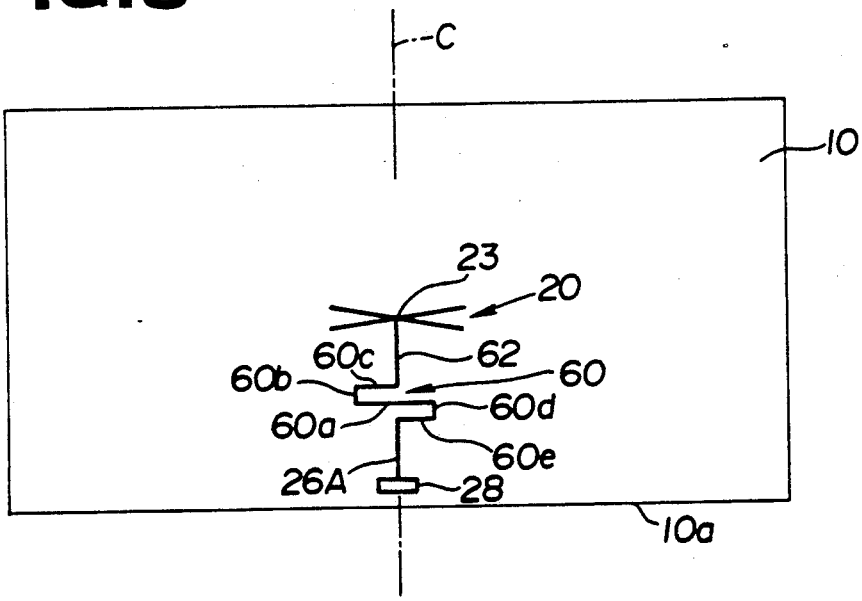

FIG. 5 shows the antenna of Example 5. This antenna included an auxiliary antenna element 60 between the main element 20 and the feed point 28. The auxiliary element 60 was a conductive strip bent so as to have a linear portion and two L-shaped portions. That is, this element 60 had a lateral segment 60*a* arranged so as to be bisected by the center axis C, a longitudinal segment 60*b* extending from one end of the lateral segment 60*a* toward the main element 20, a lateral segment 60*c* extending from the end of the segment 60*b* to the center axis C, another longitudinal segment 60*d* extending from the other end of the lateral segment 60*a* toward the rear edge 10*a* of the roof glass, and another lateral segment 60*e* extending from the end of the segment 60*d* to the center axis C. At the end of the lateral segment 60*c* the auxiliary element 60 was connected to the intersection 23 of the main element 20 by a connection line 62, and at the end of the segment 60*e* the auxiliary element 60 was connected to the feed point 28 by a connection line 26A. Each of these connection lines 62 and 26A has a length of 50 mm. The lateral segment 60*a* of the auxiliary element 60 was 60 mm; each of the two longitudinal segments 60*b* and 60*d* was 10 mm long; and each of the two lateral segments 60*c* and 60*e* was 30 mm long.

In receiving FM broadcast waves and TV broadcast waves, average gains (vs. standard dipole antenna) of the antennas of Examples 2 to 5 (shown in FIGS. 2 to 5, respectively) were as shown in Table 2. For comparison, the average gains of the antenna of Example 1 (FIG. 1) are also shown in Table 2.

TABLE 2

| | Average Gain (dB) | | | |
|---|---|---|---|---|
| | FM Radio | | TV | |
| Antenna | 76-90 MHz | 88-108 MHz | VHF | UHF |
| Example 1 | −19.3 | −17.7 | −17.5 | −16.0 |
| Example 2 | −19.5 | −17.5 | −17.0 | −15.6 |
| Example 3 | −19.1 | −17.6 | −17.2 | −15.9 |
| Example 4 | −18.8 | −17.7 | −17.3 | −15.8 |
| Example 5 | −19.4 | −17.8 | −17.4 | −15.2 |

The data in Table 2 indicate that for the reception of TV broadcast waves of either the VHF band or the UHF band the efficiency of an antenna according to the invention can be enhanced by including an auxiliary antenna element of a relatively simple pattern.

It is optional to provide a vehicle roof glass with two (or more) antennas according to the invention in order to make diversity reception. In this option it is suitable to position one antenna on the right-hand side of the longitudinal center axis (C) of the vehicle body and another antenna on the left-hand side of the center axis. Also it is optional and rather favorable to constitute a diversity reception system by combining a roof glass antenna according to the invention with a different antenna such as a conventional pole antenna or an antenna on a window glass.

In the case of applying the invention to a vehicle roof glass using laminated glass, every element of the antenna may be formed of a thin metal wire or foil and embedded in the synthetic resin flim(s) interposed between the two sheets of glass.

What is claimed is:

1. An antenna for receiving broadcast waves attached to a glass plate fitted in an opening of a roof of a vehicle body, the antenna consisting essentially of:

a main antenna element which is a combination of two linear segments each of which is a conductive strip attached to the glass plate, said two linear segments respectively extending obliquely with respect to the longitudinal center axis of the vehicle body as to intersect each other;

a feed point attached to the glass plate; and a connection line which connects said main antenna element to said feed point and extend substantially parallel to the longitudinal center axis of the vehicle body wherein a maximum distance between said two linear segments is in a range from 80 to 500 mm and a distance of one end of one of said two linear segments from the nearer end of the other of said two linear segments is in a range from 5 to 150 mm.

2. An antenna according to claim 1, wherein the distance of said main antenna element from each edge of the glass plate is not shorter than 30 mm.

3. An antenna according to claim 2, wherein said main antenna element is disposed in a central region of the glass plate so as to intersect said center axis.

4. An antenna according to claim 3, wherein said feed point and said connection line are disposed substantially on said center axis.

5. An antenna according to claim 1, wherein said vehicle body is an automobile body.

6. An antenna for receiving broadcast waves attached to a glass plate fitted in an opening of a roof of a vehicle body, the antenna consisting essentially of:

a main antenna element which is a combination of two linear segments each of which is a conductive strip attached to the glass plate, said two linear segments respectively extending obliquely with respect to the longitudinal center axis of the vehicle body so as to intersect each other;

a feed point attached to the glass plate; and a connection line which connects said main antenna element to said feed point and extends substantially parallel to the longitudinal center axis of the vehicle body wherein said two linear segments of said main antenna element have the same length and biset each other.

7. An antenna according to claim 6, wherein the maximum distance between said two linear segments is in the range from 80 to 500 mm.

8. An antenna according to claim 7, wherein the distance of one end of one of said two linear segments from the nearer end of the other of said two linear segments is in the range from 5 to 150 mm.

9. An antenna according to claim 8, wherein said distance of said one end of said one of said two linear segments is in the range from 5 to 100 mm.

10. An antenna according to claim 8, wherein said maximum distance is in the range from 80 to 300 mm.

11. An antenna according to claim 6, wherein the intersection of said two linear segments is disposed substantially on said center axis, said connection line extending from said intersection.

12. An antenna according to claim 11, wherein said main antenna element is bisected by said center axis such that the halves of the bisected main antenna element become symmetrical with respect to said center axis.

13. An antenna according to claim 6, wherein the distance of said main antenna element from every edge of the glass plate is not shorter than 30 mm.

14. An antenna according to claim 13, wherein said main antenna element is disposed in a central region of the glass plate so as to intersect said center axis.

15. An antenna according to claim 14, wherein said feed point and said connection line are disposed on or in the vicinity of said center axis.

16. An antenna for receiving broadcast waves attached to a glass plate fitted in an opening of a roof of a vehicle body, the antenna consisting essentially of:

a main antenna element which is a combination of two linear segments each of which is a conductive strip attached to the glass plate, said two linear segments respectively extending obliquely with respect to the longitudinal center axis of the vehicle body so as to intersect each other;

a feed point attached to the glass plate;

a connection line which connects said main antenna element to said feed point and extends substantially parallel to the longitudinal center axis of the vehicle body; and an auxiliary antenna element which is made of at least one conductive strip attached to the glass plate and connected to said feed point wherein a maximum distance between said two linear segments is in a range from 80 to 500 mm and a distance of one end of one of said two linear segments from the nearer end of the other of said two linear segments is in a range from 5 to 150 mm.

17. An antenna according to claim 16, wherein said auxiliary antenna element is directly connected with said connection line.

18. An antenna according to claim 16, wherein said auxiliary antenna element is connected to said main antenna element by another connection line.

19. An antenna according to claim 16, wherein said auxiliary antenna element is a combination of two linear segments which intersect each other.

20. An antenna according to claim 16, wherein said auxiliary antenna element is a conductive strip having at least one bend.

21. An antenna according to claim 20, wherein said auxiliary antenna element comprises at least one L-shaped portion.

22. An antenna according to claim 20, wherein said auxiliary antenna element comprises a portion in the shape of three sides of a rectangle.

23. An antenna according to claim 16, wherein the distance of said main antenna element from each edge of the glass plate is not shorter than 30 mm.

24. An antenna according to claim 23, wherein said main antenna element is disposed in a central region of the glass plate so as to intersect said center axis.

25. An antenna according to claim 24, wherein said feed point and said connection line are disposed substantially on said center axis.

26. An antenna according to claim 16, wherein said vehicle body is an automobile body.

27. An antenna for receiving broadcast waves attached to a glass plate fitted in an opening of a roof of a vehicle body, the antenna consisting essentially of:

a main antenna element which is a combination of two linear segments each of which is a conductive strip attached to the glass plate, said two linear segments respectively extending obliquely with respect to the longitudinal center axis of the vehicle body so as to intersect each other;

a feed point attached to the glass plate;

a connection line which connects said main antenna element to said feed point and extends substantially parallel to the longitudinal center axis of the vehicle body; and an auxiliary antenna element which is made of at least one conductive strip attached to the glass plate and connected to said feed point wherein said two linear segments of said main antenna element have the same length and bisect each other.

28. An antenna according to claim 27, wherein the maximum distance between said two linear segments is in the range from 80 to 500 mm.

29. An antenna according to claim 28, wherein the distance of one end of one of said two linear segments from the nearer end of the other of said two linear segments is in the range from 5 to 150 mm.

30. An antenna according to claim 29, wherein said distance of said one end of said one of said two linear segments is in the range from 5 to 100 mm.

31. An antenna according to claim 29, wherein said maximum distance is in the range from 80 to 300 mm.

32. An antenna according to claim 27, wherein the intersection of said two linear segments is disposed substantially on, said connection line extending from said intersection.

33. An antenna according to claim 32, wherein said main antenna element is bisected by said center axis such that the halves of the bisected main antenna element become symmetrical with respect to said center axis.

34. An antenna according to claim 27, wherein said auxiliary antenna element is directly connected with said connection line.

35. An antenna according to claim 27, wherein said auxiliary antenna element is connected to said main antenna element by another connection line.

36. An antenna according to claim 27, wherein said auxiliary antenna element is a combination of two linear segments which intersect each other.

37. An antenna according to claim 27, wherein said auxiliary antenna element is a conductive strip having at least one bend.

38. An antenna according to claim 37, wherein said auxiliary antenna element comprises at least one L-shaped portion.

39. An antenna according to claim 37, wherein said auxiliary antenna element comprises a portion in the shape of three sides of a rectangle.

40. An antenna according to claim 27, wherein said vehicle body is an automobile body.

41. An antenna according to claim 27, wherein the distance of said main antenna element from every edge of the glass plate is not shorter than 30 mm.

42. An antenna according to claim 41, wherein said main antenna element is disposed in a central region of the glass plate so as to intersect said center axis.

43. An antenna according to claim 42, wherein said feed point and said connection line are disposed substantially on said center axis.

* * * * *